US006945912B2

(12) United States Patent
Levi

(10) Patent No.: US 6,945,912 B2
(45) Date of Patent: Sep. 20, 2005

(54) EXERCISE TREADMILL WITH SLOPE ADJUSTMENT

(76) Inventor: Avraham Y. Levi, 1339 Towerview Rd., Eagan, MN (US) 55121

( * ) Notice: Subject to any disclaimer, the term of this patent is extended or adjusted under 35 U.S.C. 154(b) by 124 days.

(21) Appl. No.: 10/388,714

(22) Filed: Mar. 14, 2003

(65) Prior Publication Data

US 2004/0180757 A1 Sep. 16, 2004

(51) Int. Cl.[7] ..... A63B 22/02
(52) U.S. Cl. ..... 482/54
(58) Field of Search ..... 482/51, 54, 1–8

(56) References Cited

U.S. PATENT DOCUMENTS 4,918,766 A * 4/1990 Leonaggeo, Jr. ..... 4/495
4,951,447 A * 8/1990 Denda et al. ..... 53/502
5,295,929 A * 3/1994 Weisz ..... 482/54
5,586,961 A * 12/1996 Quint ..... 482/111
5,803,870 A * 9/1998 Buhler ..... 482/8
5,879,270 A * 3/1999 Huish et al. ..... 482/8
6,432,026 B1 8/2002 Wang et al. ..... 482/54
6,461,275 B1 10/2002 Wang et al. ..... 482/8
6,475,121 B2 11/2002 Wang et al. ..... 482/54

* cited by examiner

*Primary Examiner*—Stephen R. Crow
(74) *Attorney, Agent, or Firm*—Nikolai & Mersereau, P.A.

(57) ABSTRACT

A treadmill type exercise machine having an endless belt for simulating walking up a hill is provided. The exercise machine uses low impact walking motion, which is a favored exercise method while combining the extra effort of climbing without using the same muscle groups as a stair climbing exercise device. The treadmill is an improvement over level treadmills and inclined treadmills. The treadmill uses a cycle of 5 stages to accomplish the exercise. In the first stage the treadmill endless belt is flat, in the second stage the endless belt is moved into an inclined position, in the third stage the endless belt is raised while inclined to provide for simulated hill climbing while a person is walking on the endless belt. In the fourth stage the endless belt is leveled at a raised height. In the fifth stage the endless belt is lowered to the initial position.

14 Claims, 3 Drawing Sheets

EXERCISE TREADMILL WITH SLOPE ADJUSTMENT

BACKGROUND OF THE INVENTION

1. Field of the Invention

This invention relates to exercise treadmills and more particularly to a treadmill which changes slope and height during exercising.

2. Description of the Related Art

Walking is a very good form of exercise. It has a low impact on the body and yet increases the heart rate and expends energy to burn calories.

In the past treadmills for exercising were either flat to simulate walking on a flat surface or inclined to provide an upward slope to simulate an uphill walk designed to expend more energy than walking on a flat surface. However since the average center of gravity change of the person exercising on the upward slope treadmill is zero the exerciser on average does no work to lift his body and thus does not expend much more energy than walking on a flat surface treadmill.

Other exercise devices use a stair climbing simulation where the person has to bend his knees to expend energy to lift his body using muscles related to the bending of the knee to raise himself. This is more tiring and stressful on the body than a walking uphill on a small slope where the leg is kept essentially straight.

SUMMARY OF THE INVENTION

A treadmill is provided which has an inclined slope such that the exerciser has to raise his foot a distance x when stepping forward simulating an uphill step and simultaneously with the backward movement of his foot the treadmill is lifted such that the exerciser's foot remains at the same height rather than decline in height over the stroke of the foot in the walking cycle. Ideally the rate of raising the treadmill is the same as the rate of the excepted decline due to the slope of the treadmill. Thus the exerciser is in effect climbing a hill and raising his body without having to bend his knees as in climbing stairs. The exerciser thus has a lower impact workout than climbing stairs while working different muscles and yet expends more energy by climbing for a better workout.

OBJECTS OF THE INVENTION

It is an object of the invention to provide a better low impact workout on a treadmill.

It is an object of the invention to lift an inclined treadmill up while it is being used to simulate walking uphill.

It is an object of the invention to provide a treadmill that changes position from flat to inclined and that can be raised and lowered.

It is an object of the invention to simulate walking up a hill for exercise.

It is an object of the invention to provide a low impact climbing exercise.

It is an object of the invention to increase the workout received when using a treadmill.

Other objects, advantages and novel features of the present invention will become apparent from the following description of the preferred embodiments when considered in conjunction with the accompanying drawings.

DESCRIPTION OF THE PREFERRED EMBODIMENTS

A treadmill exercise device having several modes of operation including a level treadmill, a tilted treadmill and a hybrid treadmill for use in different exercising modes is presented. The level treadmill mode provides a simulated level field for walking or running in place, which is associated with a low level of physical effort by the user. The inclined treadmill mode provides a mode where one foot is lifted higher in front of the user and lower behind the user so the user is on a tilted surface The average center of gravity of the user does not change, however slightly more effort is required than on a level treadmill since the user's center of gravity has a small up and down movement while walking on the treadmill. The hybrid treadmill simulates a step uphill with a forward leg movement where work is done to lift the center of gravity of the person exercising followed by a backward leg movement on a uniform level followed by another uphill forward leg movement. Thus the center of gravity of the user is being raised by the effort of the user as the level of the stroke of the foot is not declining as on prior art treadmills.

Figure 1:
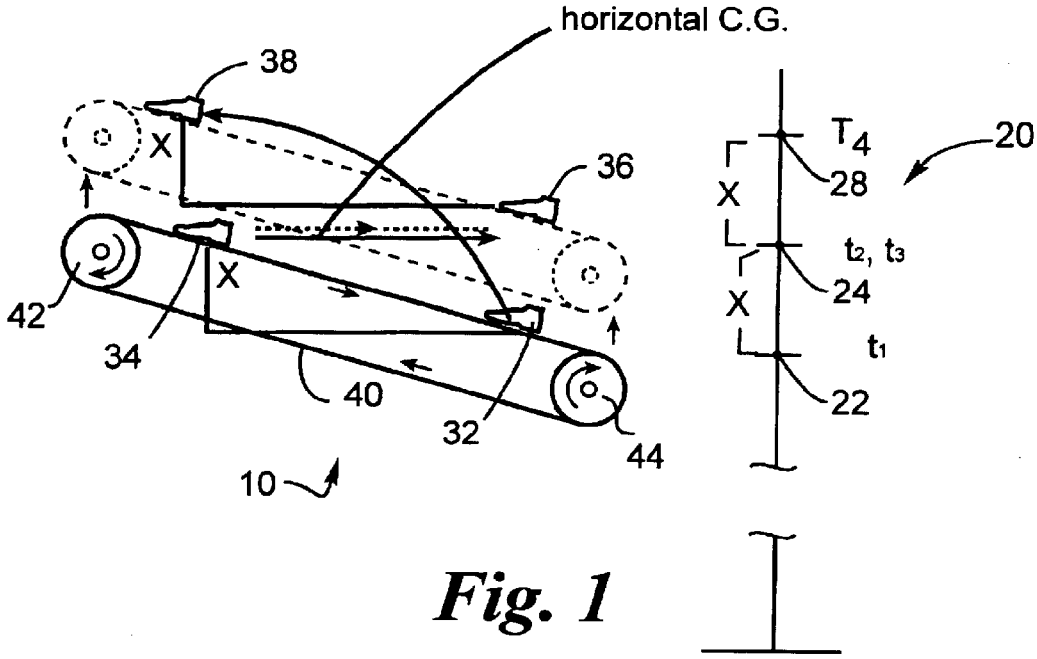
FIG. 1 is a diagram of the user's steps and center of gravity changes during a cycle of the treadmill.

A treadmill 10 has a front roller 42 a rear roller 44 and an endless belt 40 extending therebetween. As shown in FIG. 1 a treadmill 10 is inclined with front roller 42 higher than rear roller 44. At time $t_1$ the center of gravity of the exerciser is at height 22 and the foot is at position 32 on the lower end of the treadmill 40. The other foot is then moved to position 34 at time $t_2$ near the forward end of the inclined treadmill 40 which is raised a distance x by the incline of the treadmill 40. With the foot position at 34 the front and rear rollers 42 and 44 are simultaneously and continuously raised such that as the foot moves from position 34 at time $t_2$ near the front roller 42 of the treadmill 40 to position 36 near the rear roller 44, the treadmill is being raised such that the foot travels in a straight line on one level between position 34 at time $t_2$ and position 36 at time $t_3$. The center of gravity of the exerciser is raised from height 22 at position 32 to height 24 at position 34 and stays at height 24 at position 36. The pendulum like motion of the leg of the exerciser thus raises the height of the person on the treadmill providing a better workout at a lower impact than stair climbing because the knees and leg muscles are used differently and yet the center of gravity of the user has been raised from height 22 to height 24 by his own effort increasing the exercise received. The next stroke of the first foot to position 38 at time $t_4$ again raises the center of gravity of the exerciser by distance x to height 28. The benefit of the device is most efficient when the speed of the treadmill 40 and the incline, which adjusts the height of each step, and the rate at which treadmill is raised is adjusted so that the feet of the user remain at the same height from position 34 to 36. If the timing of the belt speed and the rate of increase in height are not synchronized to the speed of the users feet a benefit is still realized.

The climbing a hill simulation occurs while the treadmill is being raised. The treadmill must then be lowered to start the cycle again. For this the front roller 42 of the treadmill 40 can be lowered to level the treadmill with both front roller 42 and rear roller 44 on the same level or preferably rear roller 44 is raised to the same level as front roller 42 until the treadmill 40 is level and then both the front roller 42 and rear roller 44 are lowered in unison to provide the exerciser with a simulated walk on a flat surface, before the cycle is repeated.

Figure 2:
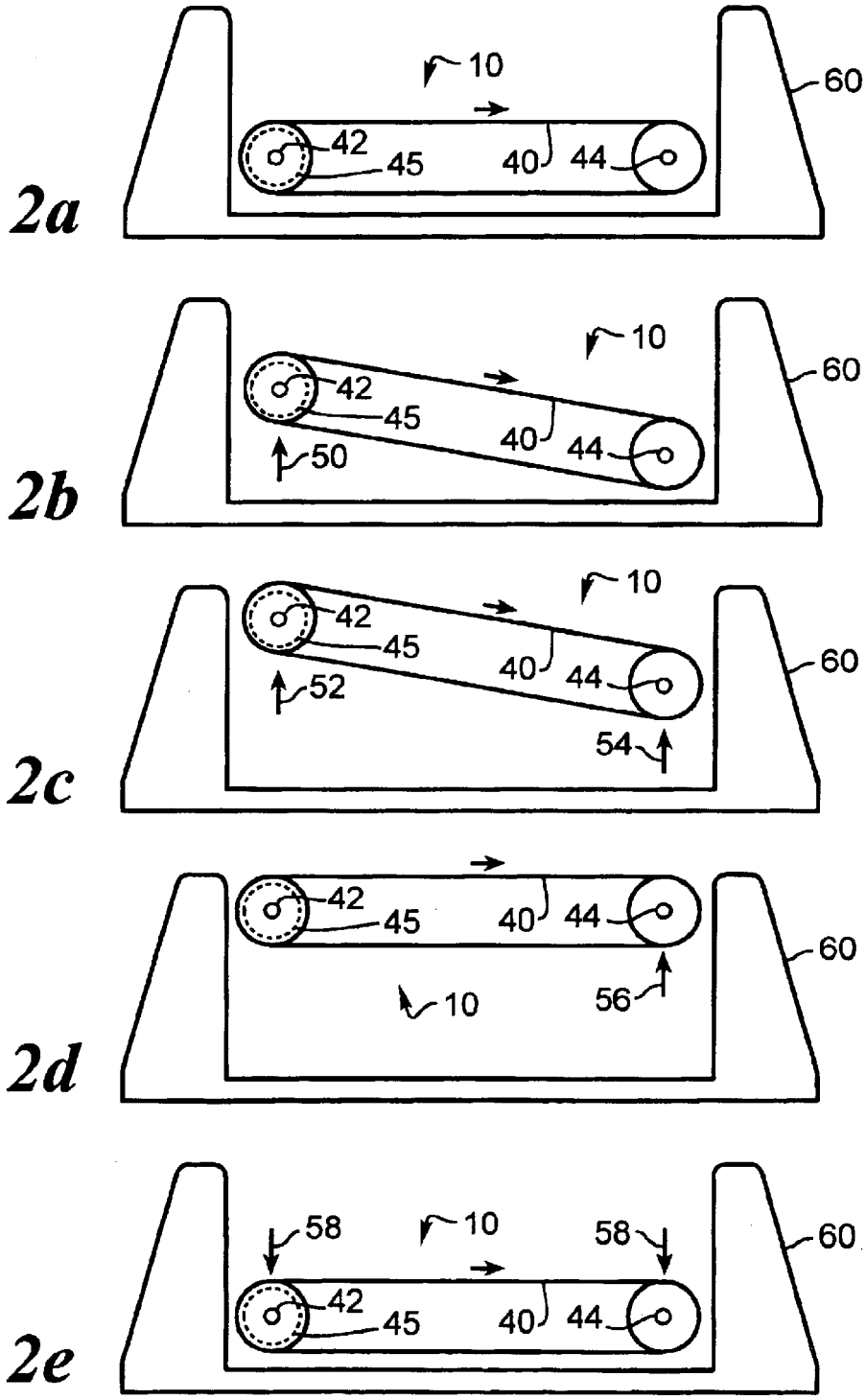
FIG. 2*a* shows stage 1 in the cycle of the treadmill during uphill simulation use.
FIG. 2*b* shows stage 2 in the cycle of the treadmill during uphill simulation use.
FIG. 2*c* shows stage 3 in the cycle of the treadmill during uphill simulation use.
FIG. 2*d* shows stage 4 in the cycle of the treadmill during uphill simulation use.
FIG. 2*e* shows stage 5 in the cycle of the treadmill during uphill simulation use.

FIG. 2 shows in five steps how the treadmill cycle starts out flat in FIG. 2*a*. Then the front roller 42 is raised as shown by arrow 50 to provide an inclined treadmill 40 in 18 FIG. 2*b*. Then the front and rear rollers 42 and 44 are raised in unison as shown by arrows 52 and 54 in FIG. 2*c*. When the treadmill reaches its maximum height the rear roller 44 is raised to be level with the front roller 52 as shown by arrow 56 in FIG. 2*d*. The front and rear rollers 42 and 44 are lowered in unison as shown by arrows 58 in FIG. 2*e* until the beginning position of the cycle is reached and the cycle begins again.

In an alternative embodiment the treadmill lifter can raise and lower the endless belt 40 while it is inclined as in FIG. 2*c* thus not requiring the endless belt to be flat as in FIGS. 1 and 5. The endless belt may have an adjustable incline or a fixed incline.

Figure 3:
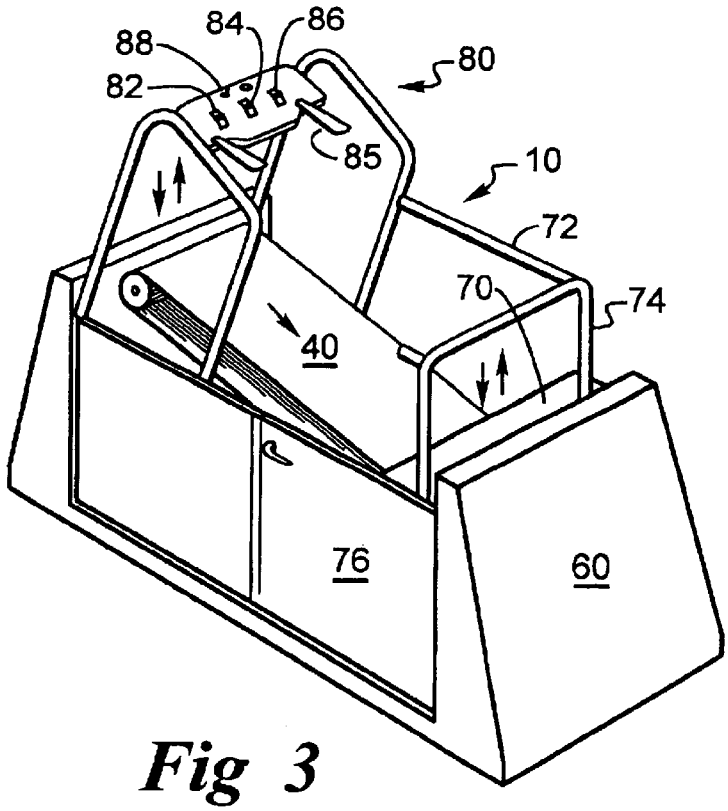
FIG. 3 is a perspective view of the treadmill with railings in a housing.

In FIG. 3 a housing 60 with doors 76 are shown. Posts 84 support rails 72 for safety. The control panel 80 supported on post 89 attached to frame 125, has controls 82 for the speed of the treadmill endless belt 40, controls 84 for the incline of the endless belt 40, and controls 86 for the speed of the cycle of raising and lowering the endless belt 40. A platform 70 at the back of the endless belt 40 allows the user to stand on the platform for safety if he is moved off the back of the endless belt 40 when at a height above the ground, and for mounting and dismounting from the treadmill 10. Handrails 85 may be used for added safety.

Figure 4:
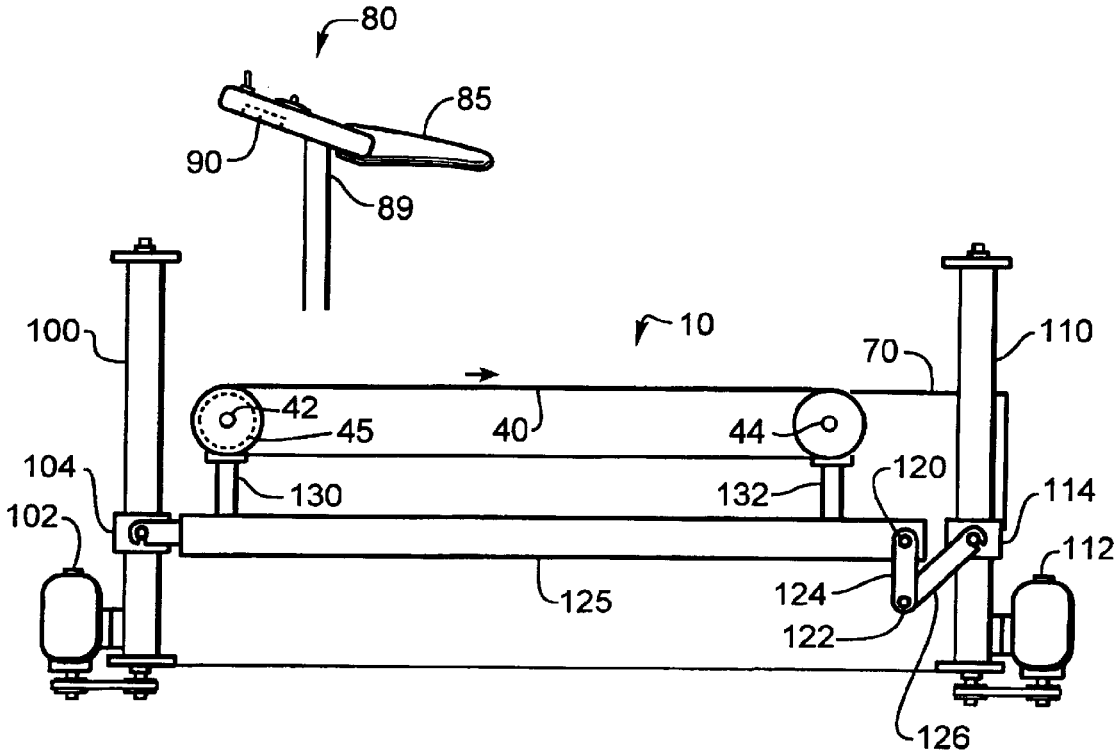
FIG. 4 is a side schematic view of the treadmill.

FIG. 4 shows a mechanism for raising and lowering the treadmill 10 as shown and described above. A treadmill having an endless belt 40 on a front roller 42 and a rear roller 44 is placed on a frame 125 and held on by support members 130 and 132 in the front and rear respectively. In this manner any treadmill can be adapted for use with the invention. A front screw jack 100 having a lifter bar 104 can lift the front end of the treadmill thus raising front roller 42. An electric motor 102 connected to the screw jack 100 can be controlled from controller 90 on control panel 80 to properly position front roller 42. A rear screw jack 110 having a lifter bar 114 can lift the rear end of the treadmill thus raising rear roller 44. An electric motor 112 connected to the screw jack 110 can be controlled from controller 90 on control panel 80 to properly position rear roller 44. The controller 90 also controls the speed of electric motor 45 on front roller 42 to control the speed of endless belt 40. Frame 125 is pivotally connected at joint 120 to arm 124, which in turn is pivotally connected at joint 122 to arm 126 to support frame 125 between screw jacks 100 and 110 so that the treadmill can be held flat or inclined.

The controller controls the cycles of the treadmill 10 so that the front 100 and rear 110 screw jacks move in unison when needed and so that the incline of the endless belt 40 can be set.

In a preferred embodiment platform 70 rides up and down on lifter bar 114 so it is always in position at the end of the endless belt 40.

The treadmill 10 can be used in several modes. It can be used in the flat mode to provide a simulated level walking. The treadmill 10 can also be set to an inclined position with the front roller 42 higher than the rear roller 44 or it can be set to a declined position with the front roller 42 lower than the rear roller 44. In a third mode the cycle of having a flat mode and inclined lifting mode can be used to simulate walking up a hill.

The number of steps taken during the stage where the endless belt 40 is rising will vary depending on the endless belt 40 speed and the speed of the cycle.

Although electric motors 45, 102 and 112 are used in the embodiment of the invention shown hydraulic motors or other types of motors or actuators may be used.

In the embodiment shown separate screw jacks in the front and rear of the treadmill lift the treadmill and tilt it to desired positions. Other means besides a screw jack such as hydraulics may be used to raise and lower the treadmill. Further a single post may be used to raise the frame of the treadmill and then the frame tilted as desired to follow the positions in the cycles used for the treadmill.

Obviously, many modifications and variations of the present invention are possible in light of the above teachings. It is therefore to be understood that, within the scope of the appended claims, the invention may be practiced otherwise than as specifically described.

What is claimed is:

1. A cycling adjustable height inclined treadmill comprising:

a means for raising and lowering an inclined treadmill, a controller for controlling the rate of raising and lowering the inclined treadmill over a controlled cycle at a rate such that the raised foot of the user contacting the top of the inclined treadmill stays at the same height as the foot travels rearward on the treadmill, simulating climbing a hill thereby increasing the exercise of the user.

2. A cycling adjustable height inclined treadmill as in claim 1 having, a means for adjusting the angle of incline of the inclined treadmill.

3. A cycling adjustable height inclined treadmill as in claim 1 having, a means for adjusting the speed of an endless belt on the treadmill.

4. A cycling adjustable height inclined treadmill as in claim 2 having, a means for adjusting the speed of an endless belt on the treadmill.

5. A cycling adjustable height inclined treadmill comprising:

a treadmill having, a front roller, a rear roller, an endless belt extending therebetween, and a motor for driving the endless belt at a desired speed, a means for adjusting the height of the front roller relative to the height of the rear roller, a controller programmed to raise and lower the treadmill while the treadmill remains at a fixed inclination at a rate such that the raised foot of the user contacting the top of the inclined treadmill stays at the same height as the foot travels rearward on the treadmill, simulating climbing a hill thereby increasing the exercise of the user.

6. A cycling adjustable height inclined treadmill as in claim 5 having:

a means for adjusting the speed of an endless belt on the treadmill.

7. A method of exercising on a treadmill comprising:

walking on an inclined endless belt with the altitude of the inclined endless belt increasing at a rate such that the raised foot of the user contacting the top of the inclined treadmill stays at the same height as the foot travels rearward on the treadmill, simulating climbing a hill thereby increasing the exercise of the user.

8. A method of exercising on a treadmill as in claim 7 with the additional step of, adjusting the angle of inclination of the endless belt to change the slope and the height gained for each step while walking on the endless belt.

9. A method of exercising on a treadmill as in claim 7 with the additional step of, adjusting the speed of the endless belt.

10. A method of exercising on a treadmill as in claim 7 with the additional step of, decreasing the altitude of the inclined endless belt at a desired rate.

11. A method of exercising on a treadmill as in claim 8 with the additional step of, adjusting the speed of the endless belt.

12. A method of exercising on a treadmill as in claim 8 with the additional step of, decreasing the altitude of the inclined endless belt at a desired rate.

13. A method of exercising on a treadmill as in claim 9 with the additional step of, adjusting the speed of the endless belt.

14. A method of exercising on a treadmill as in claim 9 with the additional step of, decreasing the altitude of the inclined endless belt at a desired rate.

* * * * *